US009523365B2

(12) United States Patent
Kiesbauer et al.

(10) Patent No.: US 9,523,365 B2
(45) Date of Patent: Dec. 20, 2016

(54) DECOUPLING OF CONTROLLED VARIABLES IN A FLUID CONVEYING SYSTEM WITH DEAD TIME

(75) Inventors: Joerg Kiesbauer, Eppertshausen (DE); Domagoj Vnucec, Ilvesheim (DE); Julian Fuchs, Darmstadt (DE); Ulrich Konigorski, Bruchsal (DE); Manfred Oesterle, Neustadt/Weinstrasse (DE); Thomas Paulus, Schiffweiler (DE)

(73) Assignees: KSB Aktiengesellschaft, Frankenthal (DE); SAMSON AKTIENGESELLSCHAFT, Frankfurt (DE)

( * ) Notice: Subject to any disclaimer, the term of this patent is extended or adjusted under 35 U.S.C. 154(b) by 130 days.

(21) Appl. No.: 13/638,717

(22) PCT Filed: Mar. 30, 2011

(86) PCT No.: PCT/EP2011/001604
§ 371 (c)(1),
(2), (4) Date: Nov. 2, 2012

(87) PCT Pub. No.: WO2011/120689
PCT Pub. Date: Oct. 6, 2011

(65) Prior Publication Data

US 2013/0037121 A1 Feb. 14, 2013

(30) Foreign Application Priority Data

Mar. 30, 2010 (DE) ..... 10 2010 013 568

(51) Int. Cl.
*F04D 15/00* (2006.01)

(52) U.S. Cl.
CPC ..... *F04D 15/0066* (2013.01); *F04D 15/0022* (2013.01); *Y10T 137/0396* (2015.04); *Y10T 137/85978* (2015.04)

(58) Field of Classification Search
CPC F04D 15/0066; F04D 27/004; F04D 15/0022; F04D 27/009
(Continued)

(56) References Cited

U.S. PATENT DOCUMENTS 6,076,951 A * 6/2000 Wang ..... G05B 13/042 700/37
6,155,790 A 12/2000 Pyotsia et al.
(Continued)

FOREIGN PATENT DOCUMENTS

DE 10007088 A1 8/2001
DE 69911306 T2 7/2004

OTHER PUBLICATIONS

Costas Kravaris et al., Deadtime Compensation for Nonlinear Processes, AICHE Journal, Sep. 1989, vol. 35, No. 9, pp. 1535-1542.*
(Continued)

*Primary Examiner* — Bryan Lettman
(74) *Attorney, Agent, or Firm* — Schiff Hardin LLP

(57) ABSTRACT

An apparatus and method for closed-loop-control of a fluid conveying system that include at least one pump, at least one consumer, at least one controller valve, and at least one armature as an actuator of the at least one control valve. Pressure and volume flow rate of the consumer are controlled independently of each other by a decoupling controller.

16 Claims, 5 Drawing Sheets

(58) Field of Classification Search
USPC ..... 417/17, 20, 26, 29, 44.2, 53, 300
See application file for complete search history.

(56) References Cited

U.S. PATENT DOCUMENTS

| | | | | |
|---|---|---|---|---|
| 6,185,468 | B1 * | 2/2001 | Wells | D21G 9/0027 162/253 |
| 6,474,951 | B2 | 11/2002 | Stephan et al. | |
| 2001/0054395 | A1 * | 12/2001 | Stephan et al. | 123/41.44 |
| 2007/0212230 | A1 | 9/2007 | Stavale et al. | |

OTHER PUBLICATIONS

Gerhard H. Nygaard et al., Automatic Coordinated Control of Pump Rates and Choke Valve for Compensating Pressure Fluctuations during Surge and Swab Operations, IADC/SPE 108344, Mar. 28-29, 2007, pp. 1-6.*

Z. Palmor, Stability properties of Smith dead-time compensator controllers, Int. J. Control, 1980, vol. 32, No. 6, pp. 937-949.

* cited by examiner

DECOUPLING OF CONTROLLED VARIABLES IN A FLUID CONVEYING SYSTEM WITH DEAD TIME

BACKGROUND

The disclosure relates to a method and an apparatus for control of a fluid conveying system, comprising at least one pump, at least one consumer as well as at least one armature as an actuator, wherein pressure and volume flow rate of the consumer are controllable.

The closed-loop-control of the process variables of the volume flow rate and thus also of the pressure is the standard task of final controlling devices in technical process installations. Valves or armatures with for example electric or pneumatic drives, also known as control valve or armature with actuator, are preferably used as final controlling devices. Their adjustable flow resistances affect the volume flow rate and the pressure within the installation.

Besides the valves, pumps are the most important components of an installation, as they are causing the movement of fluid. Among the wide range of possible pump designs, the centrifugal pump with drive, in most cases an electric motor with a frequency converter, is the standard solution in many areas of application. Closed-loop-control of process variables by means of a pump can be achieved via the rotation speed of the pump. Just like the stroke or the valve/armature position in case of a valve, in case of a pump the volume flow rate and thus the pressure is affected by changing the rotation speed. Even though in new technical process installations today the portion of speed controlled drives amounts to about 20% to 25%, these are rarely integrated actively into the process control but are rather employed for stationary correction of the pump operating point.

A large number of applications include closed-loop-control tasks requiring for example a large adjustment range owing to the process variables. This task cannot be realized through closed-loop-control by means of the pump only on the one hand and through closed-loop-control with an armature as actuator only on the other hand. The combined use of pump and valve with associated controller opens up new possibilities in process design. However, by combining the devices the controller design becomes more complex since a multi-variable system with 2 inputs must be dealt with. Besides the coupling of the process variables, dead-times often occur in technical process installations, which additionally complicates the closed-loop-control task.

SUMMARY

It is an object to develop a closed-loop-control concept for an installation that allows to independently act at a consumer upon the two process variables present in the installation, that is pressure and volume flow rate. The installation provides an arrangement of at least one pump, at least one consumer and at least one armature as actuator.

In a method or apparatus for closed-loop-control of a fluid conveying system, at least one pump, at least one consumer, at least one control valve, and at least one armature as an actuator of said control valve are provided. Pressure and volume flow rate of the consumer are controlled independently of each other by means of a decoupling controller.

DESCRIPTION OF PREFERRED EXEMPLARY EMBODIMENT

Figure 1:
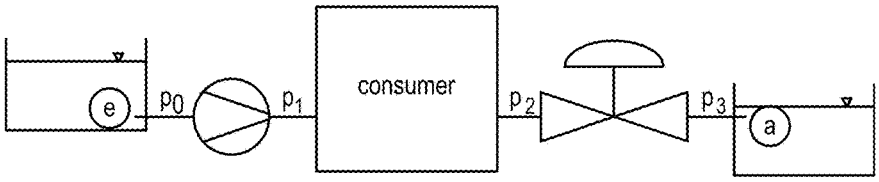
FIG. 1 is a model of a test bench.

For the purposes of promoting an understanding of the principles of the invention, reference will now be made to the preferred exemplary embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

The control target achieved in the controller design enables a high control dynamic, notwithstanding the occurring dead-time, an unprecedentedly low oscillation tendency of the controlled variables, as well as a high stationary control accuracy. Additionally, the controlled variables pressure and volume flow rate at a consumer are decoupled.

When designing the model it was assumed that a flow is balanced at an entry e and an exit a of a fluid conveying system, i.e. no significant changes of the flow variables occur across the cross-sectional area of a connecting duct system. This applies when in the areas concerned a duct cross section is constant and a frictional effect of duct walls is low. In the area between inlet and outlet a three-dimensional flow profile is allowed for. Under these assumptions the flow can be described by the flow variables along a mean flow line according to flow line theory. In this context the Bernoulli equation $$\varrho g z(s) + p(s,t) + \frac{\varrho}{2} c(s,t)^2 + \varrho \int_e^a \frac{\partial c(s,t)}{\partial t} \partial s = const \tag{1}$$

applies, with:

g=gravitational acceleration z=height coordinate c=flow speed ρ=fluid density s=trajectory coordinate p=pressure The flow speed is described by the quotient of volume flow rate Q over the cross-sectional area A through which the flow passes. If the fluid is incompressible and the flow cross section is constant, then c=f(t) applies, and the solution to the integral can be expressed in general terms:

$$\varrho \int_e^a \frac{\partial c(t)}{\partial t} \partial s = \frac{\varrho L}{\frac{A}{a_B}} \dot{Q}(t) \tag{2}$$

L denominates the conduit length along the flow line between the points e and a.

Since the Bernoulli equation only describes flow without friction, frictional effects are described phenomenologically within flow line theory by means of pressure sinks $\Delta p_c$ at the valve and $\Delta p_c$ at the consumer. Analogously a pressure increase within the pump $\Delta p_p$ is described as pressure source. Thus, the following relationship results for the Bernoulli-equation between the points e and a:

$$\varrho g(z_a - z_e) + p_a(t) - p_e(t) + \frac{\varrho}{2}(c_a^2(t) - c_e^2(t)) = -a_B\dot{Q}(t) + \Delta p_p(t) - \Delta p_v(t) - \Delta p_c(t) \quad (3)$$

The model of a test bench used for the experiments assumes for the following simplifications:

$c_a = c_e$ (incompressible, constant cross section)

$z_a = z_e$ (geodetic height difference small)

$p_a = p_e$ (open container, constant ambient pressure)

With these assumptions it follows for the fluid dynamic $$\dot{Q}(t) = \frac{1}{a_B}[\Delta p_p(t) - \Delta p_v(t) - \Delta p_c(t)]. \quad (4)$$

Besides the fluid dynamic the dynamic of the final controlling devices, i.e. of pump and valve play a decisive roll for the total dynamic of the installation. The used final controlling devices dispose of subordinate controls that adjust in stationary fashion the control variables stroke H of the valve and rotational speed n of the pump exactly to the predetermined setpoint values. The dynamic behavior of the final controlling devices is modelled as a first order delay element, respectively. It follows for the dynamic of the final controlling devices $$\dot{H}(t) = \frac{1}{T_H}(H_{soll}(t) - H(t)) \quad (5)$$

$$\dot{n}(t) = \frac{1}{T_n}(n_{soll}(t) - n(t)). \quad (6)$$

The control variables H and n influence the relationship between the process variables.

The relationship between differential pressure $\Delta p_v$ and volume flow rate Q of the valve is dependent on the medium used, the flow coefficient $K_{v,v}$ and on installation and flow conditions. Water is used as a fluid, and a turbulent flow as well as standardized installation conditions without fittings are assumed. Then the relationship $$\Delta p_v(t) = \frac{Q^2(t)}{K_{v,v}^2(t)} \cdot \Delta p_{ref}, \quad (7)$$

applies, wherein $\Delta p_{ref}$ denominates the reference pressure of one Bar. The dependency of the flow coefficient of the valve $K_{v,v}$ on the valve stroke H is described via a non-linear valve characteristic. The relationship $$\Delta p_c(t) = \frac{Q^2(t)}{K_{v,c}^2} \cdot \Delta p_{ref}., \quad (8)$$

known from equation (7), also applies in relation to the differential pressure of a consumer $\Delta p_c$ and the flow Q, wherein, however, the $K_{v,c}$-value of a consumer is usually constant. The relationship between the process variables rotational speed n, flow Q and differential pressure $\Delta p_p$ of a pump is described by the so-called throttling curve $$\Delta p_p(t) = h_{nn}n^2(t) + h_{n,v}n(t)Q(t) + h_{vv}Q^2(t). \quad (9)$$

The derivation of equation (9) was given in the standard work of C. Pfleiderer, Die Kreiselpumpen, Springer-Verlag, 4th edition, 1955, analogously. The denomination of the variables is modelled on a publication by R. Isermann, Mechatronische Systeme, Springer-Verlag, 4th edition, 2008.

From the equations (4), (5) and (6) the state space model of the installation can be derived with the states Q(t), H(t) and n(t) and the inputs $H_{soll}(t)$ and $n_{soll}(t)$. For this purpose the pressures in (4) are eliminated by substituting (7), (8) and (9). According to the definition of the control targets, $$y_1(t) = Q(t) \quad (10)$$

$$y_2(t) = p_1(t) = p_e(t) + \Delta p_p(t) \quad (11)$$

applies for the output values $\underline{y}$.

In summary it follows the state space model (12). For reasons of clarity, in the following the time dependence of the variables is omitted.

$$\dot{\underline{x}} = \underline{f}(x) + \underline{G} \cdot n$$

$$\underline{y} = \underline{h}(x) \quad (12)$$

with $$\underline{x} = (Q\ H\ n)^T$$

$$\underline{f}(x) = \begin{pmatrix} \frac{1}{a_b}\left[h_{nn} \cdot n^2 + h_v \cdot nQ + \left(h_{vv} + \frac{1}{K_{v,v}^2(H)} + \frac{1}{K_{v,c}^2}\right) \cdot Q^2\right] \\ -\frac{1}{T_H} \cdot H \\ -\frac{1}{T_n} \cdot n \end{pmatrix}$$

$$\underline{G} = \begin{bmatrix} 0 & 0 \\ \frac{1}{T_H} & 0 \\ 0 & \frac{1}{T_n} \end{bmatrix}$$

$$\underline{h}(x) = \begin{pmatrix} Q \\ p_e + h_{nn}\ n^2 + h_{nv}\ nQ + h_{vv}\ Q^2 \end{pmatrix}$$

In practice dead-times occur owing to the signal processing in the final controlling devices and the measurement instruments. These dead-times cannot be neglected, compared to the process dynamic. Likewise, if an inductive flow sensor is used, dead-times must be accounted for in the model. It was realized that an improvement of the control can be achieved by means of a decoupling of the controlled variables.

A control path is assumed to be coupled when an output $y_i$ is controlled by several manipulated variables $u_j$. Ideally, the decoupling controller is comprised of a coupling between the setpoint variables $w_i$ and the manipulated variables $u_j$, the coupling being inverse to the control path. In the controlled entire system each output $y_i$ is thus dependant on only one setpoint variable $w_i$, owing to the effect of the controller.

The couplings in the system cannot be derived directly from the state space model (12) since the manipulated variable u generally only acts upon one of the higher derivatives of the output y. Thus, the first step in the controller design is the calculation of the derivatives, which explicitly depend on the system inputs. For this purpose, the Lie-derivative is introduced for simplification. The Lie-derivative $L_f h_i(x)$ describes the derivative of the function $h_i(x)$ along the vector field f(x)

$$L_f h_i(x) = \frac{dh_i}{dx} \underline{f}(x). \tag{13}$$

With this the derivatives of a system output $y_i$ can be given as follows.

$$y_i = h_i(x) \tag{14}$$

$$\begin{aligned} \dot{y}_i &= \frac{dh_i}{dt} = \frac{dh_i}{dx}\frac{dx}{dt} \\ &= \left(\frac{dh_i}{dx}\right)^T \cdot \underline{f}(x) + \left(\frac{dh_i}{dx}\right)^T \cdot \underline{G}(x)\ \underline{u} \\ &= L_f h_i(x) + \underbrace{L_G h_i(x)}_{=0}\ \underline{u} \end{aligned} \tag{15}$$

$$\overset{(r_i)}{y_i} = L_f^{r_i} h_i(x) + \underbrace{L_G L_f^{r_i-1} h_i(x)}_{\neq 0}\ \underline{u} \tag{16}$$

Thus, the inputs $\underline{u}$ act directly onto the $r_i$-th derivative of the output $y_i$. $r_i$ referred to as relative degree of the output $y_i$. If the $r_i$-th derivative of $y_i$ is defined as a new output $y^*_i$, then the system description between $\underline{u}$ and $\underline{y}^*$ given below $$\begin{pmatrix} y_1^* \\ \vdots \\ y_m^* \end{pmatrix} \underbrace{\begin{pmatrix} L_f^{r_1} h_1(x) \\ \vdots \\ L_f^{r_m} h_m(x) \end{pmatrix}}_{c^*(x)} + \underbrace{\begin{bmatrix} L_G L_f^{r_1-1} h_1(x) \\ \vdots \\ L_G L_f^{r_m-1} h_m(x) \end{bmatrix}}_{D^*(x)} \begin{pmatrix} u_1 \\ \vdots \\ u_m \end{pmatrix} \tag{17}$$

follows. The general non-linear rule $$\underline{u} = \underline{r}(x) + \underline{V}(x) \quad W \tag{18}$$

then follows $$\underline{y}^* = \underline{c}^*(x) + \underline{D}^*(x)\underline{r}(x) + \underline{D}^*(x)\underline{V}(x) \cdot \underline{w} \tag{19}$$

for the controlled system. Since $\underline{y}^*$ describes the derivative over time of the output $\underline{y}$, the original system (12) is decoupled when the system (17) is decoupled. The setpoint variable $\underline{w}$ acts via the matrix $\underline{D}^*(x)\underline{V}(x)$ upon the outputs $\underline{y}^*$. By choosing $$\underline{D}^*(x)\underline{V}(x) = \underline{\mathrm{diag}(k_i)} \Rightarrow \underline{V}(x) = \underline{D}^*(x)^{-1} \cdot \underline{\mathrm{diag}(k_i)}, \tag{20}$$

each setpoint variable $w_i$ acts only upon the output variable $\underline{y}^*_i$ assigned to it, and equation (19) can be given line by line.

$$y_i^* = \overset{(r_i)}{y_i} = c_i^*(x) + \sum_{j=1}^{m} d_{ij}(x) \cdot r_j(x) + k_i\ w_i \tag{21}$$

Therein, i is the index of the decoupled subsystem, and m is the number of inputs and outputs. In order to calculate the controller parameters $r_j$, the desired transfer function $$G_{w,i}(s) = \frac{Y_{w,i}(s)}{W_i(s)} = \frac{a_{i,0}}{s^{r_i} + a_{i,r_i-1}\ s^{r_i-1} + \ldots + a_{i,0}} \tag{22}$$

is defined with the associated time domain representation $$y_{w,i}^{(r_i)}(t) = -a_{i,r_i-1} y_{w,i}^{(r_i-1)}(t) - \ldots - a_{i,0} y_{w,i}(t) + a_{i,0} w_i(t) \tag{23},$$

wherein the desired transfer function is stationary accurate, linear and has minimum-phase characteristics. If $k_i = a_i$, 0, is selected and $$y_{w,i}^{(r_i)}(t) = y_i^* \tag{24}$$

$$y_{w,i}^{(r_i-1)}(t) = L_f^{r_i-1} h_i(x) \tag{25}$$

is observed, then equating (21) and (23) results in the following relationship between the controller parameters r and the coefficients a of the denominator polynomial of (22)

$$\sum_{j=1}^{m} d_{i,j}\ r_j(x) = -c_i^*(x) - \sum_{k=0}^{r_i-1} a_{i,k}\ L_f^k h_i(x) \tag{26}$$

From (26) the rule $$\underline{r}(x) = \underline{D}^{*-1}(x) \left[ -\underline{c}^*(x) - \begin{pmatrix} \sum_{k=0}^{r_1-1} a_{1,k}\ L_f^k\ h_1(x) \\ \vdots \\ \sum_{k=0}^{r_m-1} a_{m,k}\ L_f^k\ h_m(x) \end{pmatrix} \right] \tag{27}$$

can be derived, which, together with the preliminary filter (20), guarantees a linear, decoupled input and output behavior with a defined pole position for each output y. The decouplability of a control path depends on two system characteristics.

Number of Inputs and Outputs

Since each controlled variable shall be influenced independently from the others, the number of inputs and outputs must be equal.

Invertibility of the Control Path

The decoupling of the control path requires the invertibility of the decouplability matrix D* (17).

Further it is to be noted that due to the decoupling a part of the system can become unobservable. The unobservable system portion is referred to as internal dynamic and is a system characteristic the stability of which is necessary for the realization of the controller. It was realized that an unstable internal dynamic can lead to an unlimited increase of the internal states and thus to a violation of control variable limits or to the destruction of the installation.

The application of the method to the model of the installation (12) results in a first order delay element (relative degree $r_1=1$) for the pressure $p_1$ and a second order delay element (relative degree $r_2=2$) for the volume flow rate Q. The relative degree of the system is determined from the sum of the relative degrees of the partial systems and corresponds here to the system order n=3. Thus, no internal dynamic occurs, and the system is decouplable in a stable manner.

The dead-times in the system are accounted for by using a Smith-Predictor. The basic structure of the Smith-Predictor is comprised of a model that is connected in parallel to the path. This enables feedback of the calculated controlled variable before it can be measured. For the control deviation e $$e = v - \underbrace{\left[G(S)e^{-T_d s} - \tilde{G}(s)e^{-\tilde{T}_d s}\right]}_{=0\ (ideal)} \cdot u - \tilde{G}(s) \cdot u \tag{28}$$

applies. Assuming an ideal model (~G(s)=G(s) and $\sim T_d = T_d$) the dead-time is thus neglected in the controller design. However, since in reality no error free model exists, the control loop is subsequently examined for its robustness with respect to model errors. In particular errors in modelling the dead-times are often described as critical. Stability examinations and criteria for linear systems can be found in the publication of Z. Palmor, Stability properties of Smith dead-time compensator controllers, Int. J Control, 32-6:937-949, 1980. The extension of the Smith-Predictor to linear systems in state space description as well as to a large class of non-linear systems was presented by C. Kravaris und R. A. Wright, Deadtime compensation for nonlinear processes, in the journal AIChE, 35-9:1535-1541, 1989. This work stated that the stability of the uncontrolled system as well as a stable zero-dynamic of the dead-time free system components are required as limitations.

Given the above conditions a state-space controller is designed for a dead-time free SISO-system (single input, single output) for the linearization of the I/O-behavior. The state-space variables necessary for the control are determined by means of a dead-time free model of the open path, referred to by C. Kravaris und R. A. Wright also as "Overall State Predictor". Some extensions are performed owing to the MIMO-system (multiple input, multiple output) on hand as well as to the fact that the dead-times of the open control path are not equal for all outputs.

Owing to the use of the path model the manipulated variables can be calculated without interference of dead-times. The decoupling of the outputs generally requires a synchronous modification of the system inputs. Since the components of the system under consideration have different dead-times, see FIG. 2, the decoupling is disturbed by setting directly the calculated manipulated variable. In order to avoid this, the input of the final control element with the shorter dead-time is additionally delayed so that the dead-times of both final control elements are equal. By using such a dead-time compensation a synchronization occurs at the outputs.

Furthermore, a modification of the feedback is performed in the outer loop. Similar to the classical Smith-Predictor, not the output variable but the difference between measured and calculated output is used for feedback. Here too the dead-time of the two real outputs must be "synchronized" with the model outputs. The advantage of this structure lies in the fact that for a suitable choice of the inner control loop a compensation of disturbances is possible. The inner control loop consists of a decoupling controller and a model. It is designed for stationary accuracy with respect to the setpoint variable ŵ by means of the preliminary filter V(x)

$$y_m(t\to\infty)=\hat{w}(t\to\infty) \tag{29}$$

Owing to model uncertainties and disturbances the output variable of the path $y_s$ will differ from the one of the model $y_m$. The difference e of the two outputs $$e=y_s-y_m \tag{30}$$

is fed back to the controller input. Then the setpoint variable ŵ can be specified in general terms by $$\hat{w}=w-e=w-(y_s-y_m) \tag{31}$$

Through transformation of (31) and substitution of (29) we find $$y_s = w - \underbrace{(\hat{w} - y_m)}_{=0\ fur\ t\to\infty} \tag{32}$$

for the stationary terminal value of the output variable. It becomes apparent that an integrating behavior with respect to disturbances is present in the outer loop owing to the stationary accuracy of the inner loop.

The design of the controller was chosen such that the two decoupled transfer functions have the same sum time constants and the dampening of the $PT_2$—system corresponds to the aperiodic limiting case. In this way a similar dynamic behavior of both outputs is achieved despite a different relative degree. In consideration of the manipulated variable limits the following transfer functions of the closed control loop were realized:

$$\text{volume flow rate: } nstrom\text{: } G_1(s) = \frac{Q}{Q_{soil}} = \frac{1}{(0.5s+1)(0.5s+1)}$$

$$G_2(s) = \frac{p_1}{p_{1_{soil}}} = \frac{1}{(s+1)}$$

At first the controlled system is tested for its response behavior. Through the combination of the final control devices valve and pump, new degrees of freedom have emerged. The controlled variables pressure and volume flow rate of a consumer can be controlled independently from each other. The controller concept was successfully implemented and verified on a test bench with dead-times. The decoupling within the entire working range was successful, and disturbances due to model errors could be compensated by means of the modified Smith-Predictor.

Figure 2:
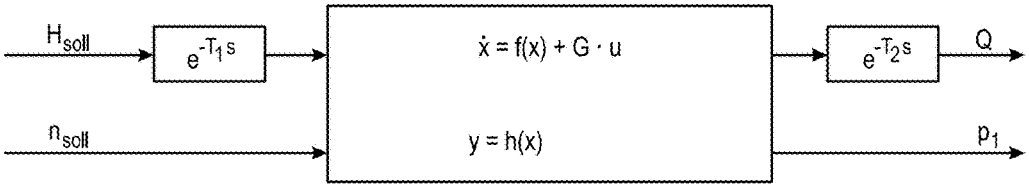
FIG. 2 is a state space model with dead-time.

FIG. 1 shows a model of an installation providing an arrangement of pump, consumer and armature as an actuator, wherein a serial arrangement has been selected in this example of an embodiment. The transfer of the method to other arrangements of pump and valve/armature are also possible. The model assumes that the flow is balanced at the inlet e and at the outlet a, i.e. that no significant changes of the flow variables occur over the cross section of the connecting duct system. This assumption holds if in the areas concerned a duct cross section is constant and a frictional effect of the duct walls is small. In the area between inlet and outlet a three-dimensional flow profile is allowed for. At a test bench about 13 m of conduit with a nominal diameter of 50 mm were installed. The instruments used are a pump of the company KSB, Type Etanorm 32-160 with frequency inverter, and a control valve of SAMSON, Type 3241 with pneumatic drive and positioner. In such a simulated installation a designed controller was tested. The behavior of a consumer was simulated by a second armature as a final control element of the above-mentioned type. With this setup examinations were possible at different path models. As a result, the test bench had the following characteristic values:

range of volume flow rate: 1.5 to 25 $m^3/h$ pressure range: 0 to 4 bar
permissible pump speed: 1000 to 3000 rpm
permissible valve stroke: 0 to 100%
dead-time $T_1$=0.15 s
dead-time $T_2$=0.8 s FIG. 2 shows a state space model of the installation, extended by the dead-times. It is valid in practice as well as at a test bench. Owing to the signal processing in the positioning devices and measurement instruments, dead-times occur, which, in contrast to a process dynamic, cannot be neglected. Likewise, dead-times need to be accounted for if a flow sensor, for instance an inductive flow sensor, is used.

Figure 3:
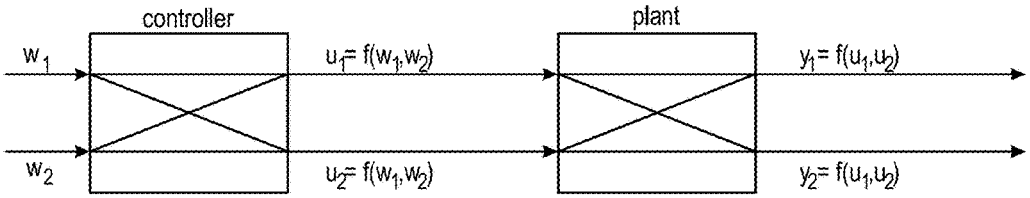
FIG. 3 is a structure of a decoupling controller.

FIG. 3 shows a coupled control path. Here an output $y_i$ is controlled by several manipulated variables $u_j$. A decoupling controller ideally comprises a coupling between a setpoint variable $w_i$ and a manipulated variable $u_j$, the coupling being inverse to the path. Thus, in the controlled entire system each controlled variable $y_i$ depends only on the setpoint variable $w_i$ due to the effect of the controller. The setpoint variables can be chosen independently of each other. FIG. 3 shows the controller structure for the case of two inputs and outputs. The couplings in the system cannot be derived directly from the state space representation because a manipulated variable u generally only acts on one of the higher derivatives of the controlled variable y.

Figure 4:
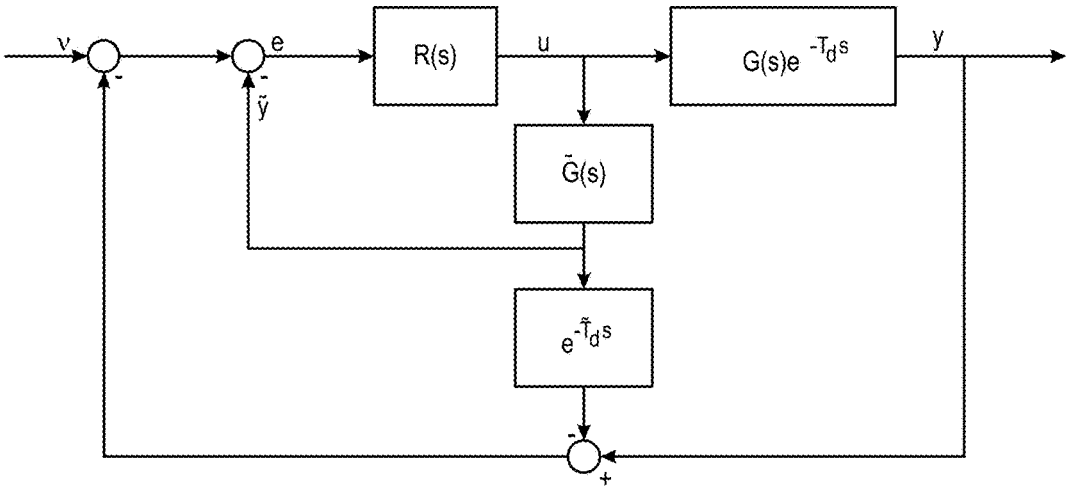
FIG. 4 is a Smith-Predictor.

FIG. 4 shows a Smith-Predictor, which is a control element, presented in frequency range representation in 1959 for linear systems, and, which ever since, is found in different applications. The basic structure of the Smith-Predictor is comprised of a model that is connected in parallel to the path. This enables the feedback of the calculated controlled variable before it can be measured.

Figure 5:
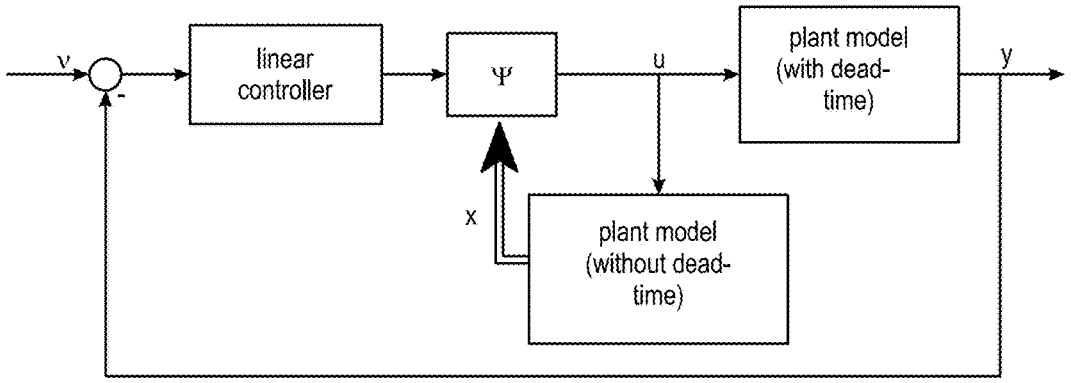
FIG. 5 is an extended Smith-Predictor.

In FIG. 5 a state-space controller is designed for a dead-time free SISO system for linearizing the I/O behavior. The state-space variables are determined by a dead-time free model of the open path. In the figure the controller structure is represented. In contrast to a classic Smith-Predictor, a comparison of the predicted and the measured output is dispensed with.

Figure 6:
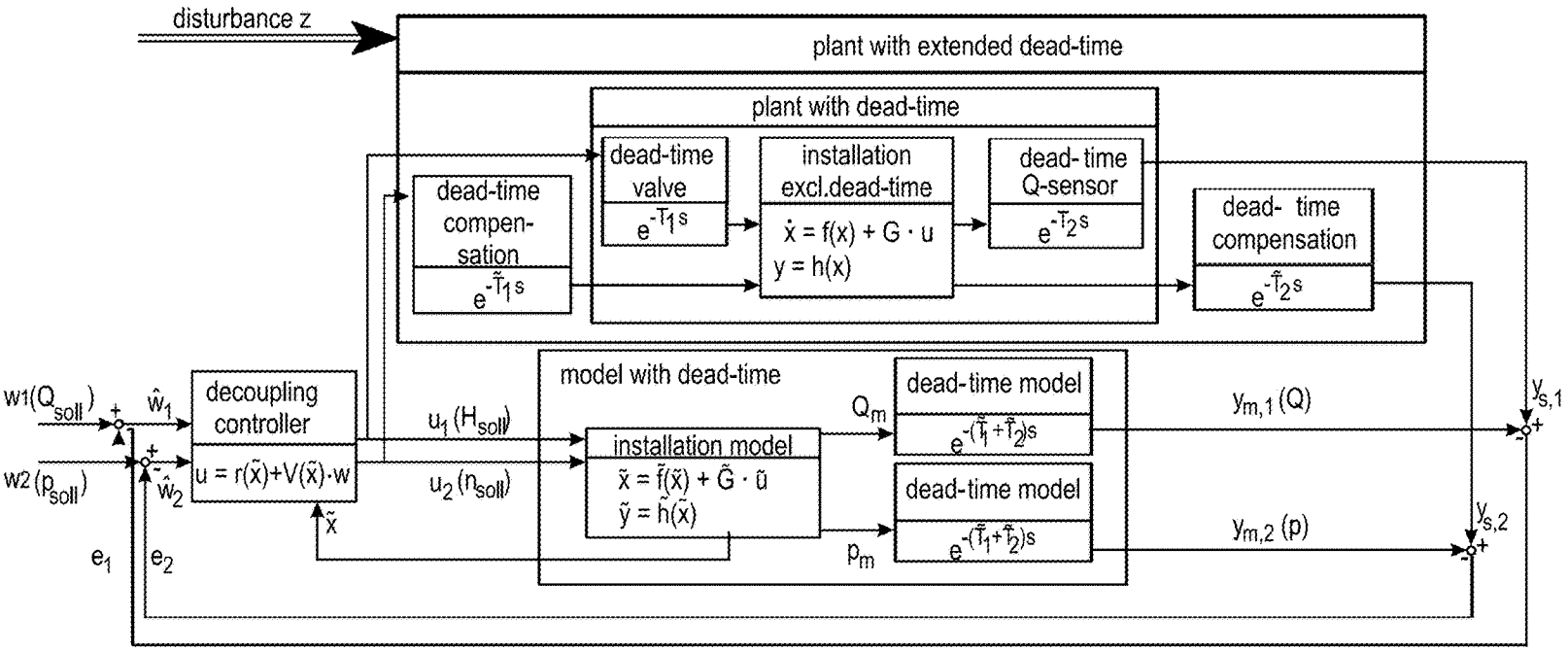
FIG. 6 is a realization of the Smith-Predictor at the test bench.

FIG. 6 shows the structure of the extended Smith-Predictor. It realizes a modification of a feedback in the outer control loop. However, unlike in the classic Smith-Predictor, not the output variable but the difference between measured and calculated output is fed back. The dead-times of the two real outputs are "synchronized" with the ones at the model outputs. The advantage of this structure lies in that a compensation of disturbances is possible, provided a suitable choice for the inner control loop.

Figure 7:
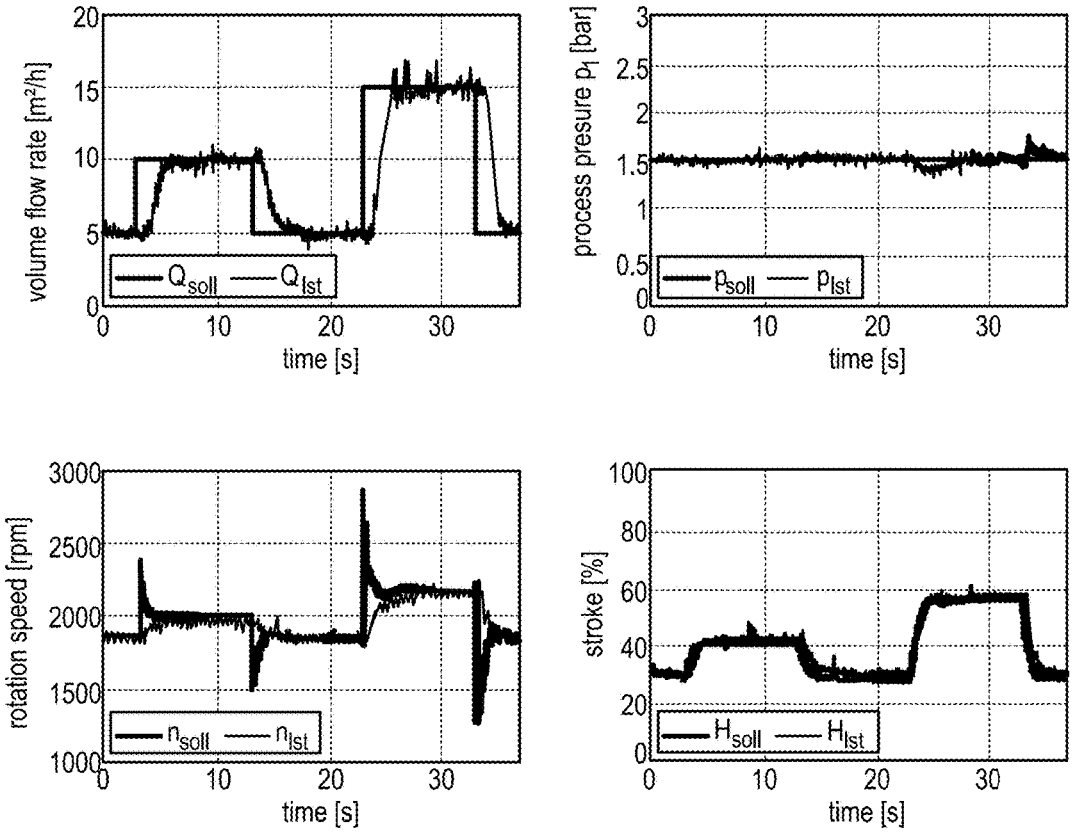
FIG. 7 are measurement results of setpoint value step-changes of the volume flow rate.

FIG. 7 shows measurement results for step changes of the setpoint value of the volume flow rate $Q_{soll}$ and for a constant setpoint value of the pressure $p_{1,soll}$. In the upper area of the figure the controlled variables and setpoint variables are represented, and in the lower area the manipulated variables as well as the state-space variables of the final control devices affected by them are shown. The dynamic behavior of the controlled variables corresponds to the specifications. Only in case of very large steps small deviations of the specified behavior of $p_1$ can be found.

Figure 8:
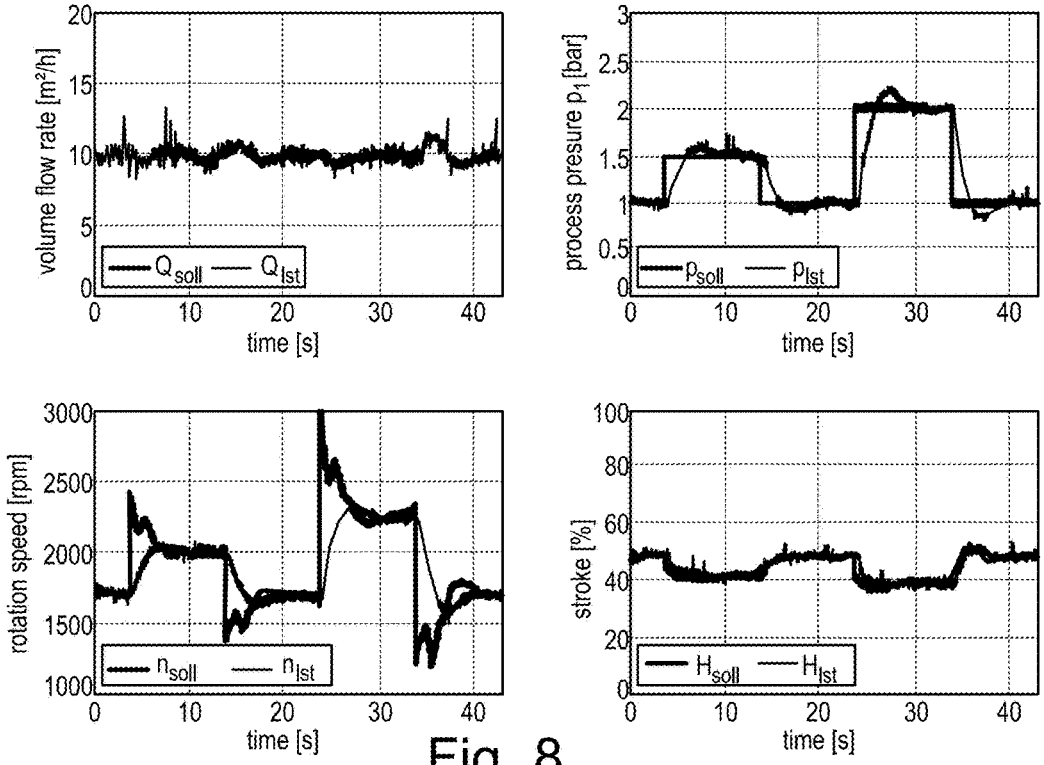
FIG. 8 are measurement results of setpoint value step-changes of the process pressure.

In FIG. 8 the reaction of the installation to step changes of the setpoint value for pressure is examined. Also here it became apparent that the decoupling of the controlled variables works successfully. However, in contrast to the design concept, the step response of the pressure displays an overshoot for large steps. The cause for this are inaccuracies in the model creation. Such a behavior is not found in simulations of the control loop. All in all, the overall transient response is nonetheless judged to be satisfactory. Finally, the disturbance response is examined. To this end the setpoint values of the controlled variables are kept constant and the drag coefficient of the consumer is changed.

Figure 9:
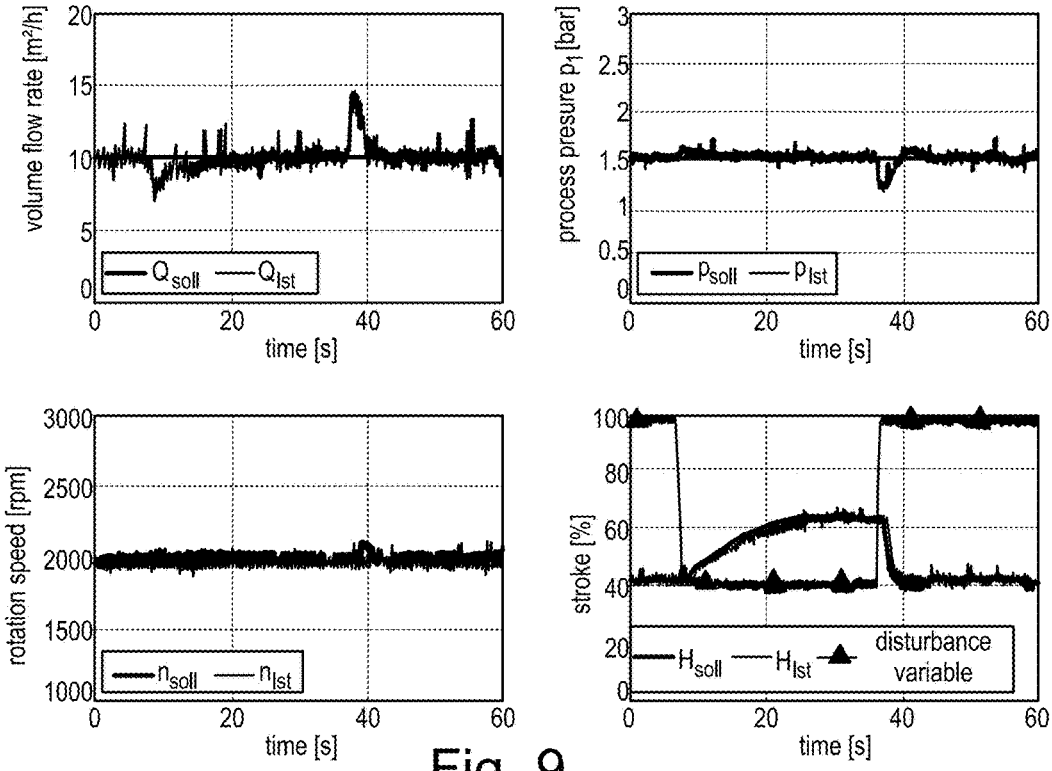
FIG. 9 shows the compensation of such disturbances.

FIG. 9 shows the reaction of the control loop to a change in stroke of the second valve, which simulates the effect of the consumer. This change in stroke is shown as an additional measurement curve in the diagram of the control valve. Closing the valve causes a reduction of the volume flow rate as well as an increase in pressure $p_1$, owing to the increased resistance. The controller reacts by adapting the manipulated variables up to the complete compensation of the disturbance. This corresponds to the expectations with respect to the integrating behavior of the Smith-Predictor.

With the preferred embodiment a tested concept for the independent control of pressure and volume flow rate of a processing installation is presented. The dynamic of such installations is strongly non-linear, wherein the controlled variables are dynamically coupled to each other. Dead-times occur due to the cycle times of the used instruments. For the control of such a system an extended Smith-Predictor is used in combination with a non-linear decoupling controller. The controlled variables and thus the setpoint variables can be chosen independently of each other. This opens new ways of process control.

Although a preferred exemplary embodiment is shown and described in detail in the drawings and in the preceding specification, it should be viewed as purely exemplary and not as limiting the invention. It is noted that only the preferred exemplary embodiment is shown and described, and all variations and modifications that presently or in the future lie within the protective scope of the invention should be protected.

The invention claimed is:

1. A method for closed-loop-control of a fluid conveying system, comprising the steps of:

providing at least one pump, at least one consumer connected to the at least one pump, at least one control valve connected to the at least one consumer, and at least one armature connected to said at least one control valve as an actuator of said at least one control valve;

controlling a pressure and a volume flow rate of the at least one consumer independently of each other using a decoupling controller connected to control at least one of: said at least one pump and said at least one armature; and the decoupling controller performing a decoupled control operation with a control rule r (x) according to $$r(x) = D^{*-1}(x)\left[-c^*(x) - \begin{pmatrix} \sum_{k=0}^{r_1-1} a_{1,k} L_f^k h_1(x) \\ \vdots \\ \sum_{k=0}^{r_m-1} a_{m,k} L_f^k h_m(x) \end{pmatrix}\right]$$

wherein D* is a decouplability matrix, a is a coefficient, x is a declaration of a state space vector, k is an index of summation, m is a number of inputs and outputs, r is a controller parameter with i being an index of the decoupled subsystem, $L_f$ is a Lie-derivative of a function h, the function h is along a vector field of the fluid, and c* is $$\begin{pmatrix} L_f^{r_1} h_1(x) \\ \vdots \\ L_f^{r_m} h_m(x) \end{pmatrix}.$$

2. The method according to claim 1 wherein the decoupling controller is based on a non-linear multivariable controller.

3. The method of claim 1 wherein the decoupling controller comprises a coupling between setpoint variables for the pressure and volume flow rate and manipulated variables of the at least one pump and the at least one control valve, the coupling being inverse to a control path in the fluid conveying system, and in the fluid conveying system the manipulated variables are controlled to achieve the pressure independent of the volume flow rate and to control the volume flow rate independent of the pressure.

4. The method according to claim 3 wherein said at least one pump and said at least one control valve with the at least one armature as the actuator are used as final controlling devices, and wherein the final controlling devices adjust the manipulated variables to achieve predetermined setpoint values for the pressure and volume flow rate.

5. The method according to claim 4 wherein dead times within the fluid conveying system are corrected and/or compensated for by using a modified Smith-Predictor.

6. The method according to claim 4 wherein an input of one of said final controlling devices with a shorter dead time is delayed such that dead times of the final controlling device are balanced.

7. The method of claim 3 wherein a decouplability of the control path in the conveying system depends on two system characteristics including the number of inputs and outputs of the system which are equal, and the decouplability matrix D* of the system is invertible.

8. The method according to claim 1 wherein the pressure and the volume flow rate are controlled by a manipulated variable position of the at least one armature and/or a rotational speed n of the pump.

9. The method of claim 1 wherein the decoupling controller comprises a coupling between setpoint variables for the pressure and volume flow rate and manipulated variables of the at least one pump and the at least one control valve, the setpoint variables and the manipulated variables being chosen independently of each other.

10. The method according to claim 1 wherein a difference between measured outputs and model outputs calculated using a model is used as a feedback of the decoupling controller, and wherein dead times of the measured outputs are synchronized with the model outputs.

11. An apparatus for closed-loop-control of a fluid conveyance system, comprising:

at least one pump, at least one consumer connected to the at least one pump, at least one control valve connected to the at least one consumer, and at least one armature connected to said at least one control valve as an actuator of said at least one control valve;

a decoupling controller connected to control at least one of: said at least one pump and said at least one armature to control a pressure and a volume flow rate of the at least one consumer independently of each other; and the decoupling controller being configured to perform a decoupled control operation with a control rule r (x) according to $$r(x) = D^{*-1}(x)\left[-c^*(x) - \begin{pmatrix} \sum_{k=0}^{r_i-1} a_{1,k} L_f^k h_1(x) \\ \vdots \\ \sum_{k=0}^{r_m-1} a_{m,k} L_f^k h_m(x) \end{pmatrix}\right]$$

wherein D* is a decouplability matrix, a is a coefficient, x is a declaration of a state space vector, k is an index of summation, m is a number of inputs and outputs, $r_i$ is a controller parameter with i being an index of the decoupled subsystem, $L_f$ is a Lie-derivative of a function h, the function h is along a vector field of the fluid, and c* is $$\begin{pmatrix} L_f^{r_1} h_1(x) \\ \vdots \\ L_f^{r_m} h_m(x) \end{pmatrix}.$$

12. The apparatus of claim 11 wherein said decoupling controller comprises a non-linear multivariable controller.

13. The apparatus according to claim 11 wherein the at least one armature comprises a stroke H of said at least one control valve.

14. The apparatus according to claim 11 wherein the decoupling controller adjusts the pressure and the volume flow rate using a manipulated variable position of the at least one armature and/or a rotational speed n of the pump using subordinate control procedures.

15. The apparatus according to claim 11 wherein a modified Smith-Predictor corrects and/or compensates for dead times of the fluid conveyance system.

16. The apparatus according to claim 11 wherein the decoupling controller comprises a coupling between setpoint variables for the pressure and volume flow rate and manipulated variables of the at least one pump and the at least one control valve, the coupling being inverse to a control path in the fluid conveying system, and in the fluid conveying system the manipulated variables are controlled to achieve the pressure independent of the volume flow rate and to control the volume flow rate independent of the pressure.

* * * * *